US008591244B2

(12) United States Patent
Thomas et al.

(10) Patent No.: US 8,591,244 B2
(45) Date of Patent: Nov. 26, 2013

(54) CABLE CONNECTOR

(75) Inventors: Charles Thomas, Athens, PA (US); Michael Dean, Waverly, NY (US); Roger Phillips, Horseheads, NY (US); Allen L. Malloy, Elmira Heights, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 162 days.

(21) Appl. No.: 13/179,158

(22) Filed: Jul. 8, 2011

(65) Prior Publication Data

US 2013/0012063 A1 Jan. 10, 2013

(51) Int. Cl.
*H01R 4/38* (2006.01)

(52) U.S. Cl.
USPC ..... 439/321; 439/578

(58) Field of Classification Search
USPC ..... 439/321, 322, 578–585
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. ARRIS Group Inc. [online]. 3 pages. [retrieved on Apr. 22, 2010]. Retrieved from the Internet<URL: http://www.arrisi.com/special/digiconAVL.asp>.

*Primary Examiner* — James Harvey
(74) *Attorney, Agent, or Firm* — Hiscock & Barclay LLP

(57) ABSTRACT

One embodiment relates to a cable connector. The cable connector includes a body having a forward end and a rearward end opposite the forward end, a post disposed at least partially within the body, a fastener coupled to the forward end of the body, and a compressible member disposed on an outer surface of the body. The post includes a flange portion extending radially from a forward end of the post. The fastener is axially movable between a forward position and a rearward position, and wherein the fastener comprises an interior surface configured to contact the flange portion of the post when the fastener is in the forward position. The compressible member is configured to force the fastener toward the forward position such that the interior surface of the fastener provides a continuous pressure against the flange of the post when the fastener is in the forward position.

15 Claims, 9 Drawing Sheets

(56) References Cited

U.S. PATENT DOCUMENTS

| | | | |
|---|---|---|---|
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |

(56) References Cited

U.S. PATENT DOCUMENTS

| | | | |
|---|---|---|---|
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A | 1/1988 | Schildkraut et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,813,886 | A | 3/1989 | Roos et al. |
| 4,820,185 | A | 4/1989 | Moulin |
| 4,834,675 | A | 5/1989 | Samchisen |
| 4,835,342 | A | 5/1989 | Guginsky |
| 4,836,801 | A | 6/1989 | Ramirez |
| 4,838,813 | A | 6/1989 | Pauza et al. |
| 4,854,893 | A | 8/1989 | Morris |
| 4,857,014 | A | 8/1989 | Alf et al. |
| 4,867,706 | A | 9/1989 | Tang |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,073,129 | A | 12/1991 | Szegda |
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,494 | A | 5/1994 | Flanagan et al. |
| 5,318,459 | A | 6/1994 | Shields |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawaguchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |

(56) References Cited

U.S. PATENT DOCUMENTS 5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,898,940 B2 5/2005 Gram et al.
6,929,508 B1 8/2005 Holland
6,939,169 B2 9/2005 Islam et al.
6,971,912 B2 12/2005 Montena et al.
7,011,547 B1 3/2006 Wu
7,029,326 B2 4/2006 Montena
7,070,447 B1 7/2006 Montena
7,086,897 B2 8/2006 Montena
7,097,499 B1 8/2006 Purdy
7,097,500 B2 8/2006 Montena
7,102,868 B2 9/2006 Montena
7,114,990 B2 10/2006 Bence et al.
7,118,416 B2 10/2006 Montena et al.
7,125,283 B1 10/2006 Lin
7,128,605 B2 10/2006 Montena
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 2/2007 Burris et al.
7,186,127 B2 3/2007 Montena
7,207,820 B1 4/2007 Montena
7,229,303 B2 6/2007 Vermoesen et al.
7,252,546 B1 8/2007 Holland

(56) References Cited

U.S. PATENT DOCUMENTS

| | | | | |
|---|---|---|---|---|
| 7,255,598 | B2 | 8/2007 | Montena et al. | |
| 7,264,503 | B2 | 9/2007 | Montena | |
| 7,299,520 | B2 | 11/2007 | Huang | |
| 7,299,550 | B2 | 11/2007 | Montena | |
| 7,300,309 | B2 | 11/2007 | Montena | |
| 7,354,309 | B2 | 4/2008 | Palinkas | |
| 7,371,112 | B2 | 5/2008 | Burris et al. | |
| 7,375,533 | B2 | 5/2008 | Gale | |
| 7,393,245 | B2 | 7/2008 | Palinkas et al. | |
| 7,404,737 | B1 | 7/2008 | Youtsey | |
| 7,452,237 | B1 | 11/2008 | Montena | |
| 7,452,239 | B2 | 11/2008 | Montena | |
| 7,455,550 | B1 | 11/2008 | Sykes | |
| 7,462,068 | B2 | 12/2008 | Amidon | |
| 7,476,127 | B1 | 1/2009 | Wei | |
| 7,479,035 | B2 | 1/2009 | Bence et al. | |
| 7,488,210 | B1 | 2/2009 | Burris et al. | |
| 7,494,355 | B2 | 2/2009 | Hughes et al. | |
| 7,497,729 | B1 | 3/2009 | Wei | |
| 7,507,117 | B2 | 3/2009 | Amidon | |
| 7,544,094 | B1 | 6/2009 | Paglia et al. | |
| 7,566,236 | B2 | 7/2009 | Malloy et al. | |
| 7,568,945 | B2 | 8/2009 | Chee et al. | |
| 7,607,942 | B1 | 10/2009 | Van Swearingen | |
| 7,674,132 | B1 | 3/2010 | Chen | |
| 7,682,177 | B2 | 3/2010 | Berthet | |
| 7,727,011 | B2 | 6/2010 | Montena et al. | |
| 7,753,705 | B2 | 7/2010 | Montena | |
| 7,753,727 | B1 | 7/2010 | Islam et al. | |
| 7,794,275 | B2 | 9/2010 | Rodrigues | |
| 7,806,714 | B2 | 10/2010 | Williams et al. | |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,828,596 | B2 | 11/2010 | Malak | |
| 7,830,154 | B2 | 11/2010 | Gale | |
| 7,833,053 | B2 | 11/2010 | Mathews | |
| 7,845,963 | B2 * | 12/2010 | Gastineau | 439/321 |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,887,354 | B2 | 2/2011 | Holliday | |
| 7,892,004 | B2 | 2/2011 | Hertzler et al. | |
| 7,892,005 | B2 | 2/2011 | Haube | |
| 7,892,024 | B1 | 2/2011 | Chen | |
| 7,927,135 | B1 | 4/2011 | Wlos | |
| 7,934,954 | B1 | 5/2011 | Chawgo et al. | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 8,029,315 | B2 | 10/2011 | Purdy et al. | |
| 8,062,044 | B2 | 11/2011 | Montena et al. | |
| 8,062,063 | B2 | 11/2011 | Malloy et al. | |
| 8,075,337 | B2 | 12/2011 | Malloy et al. | |
| 8,075,338 | B1 | 12/2011 | Montena | |
| 8,079,860 | B1 | 12/2011 | Zraik | |
| 8,113,875 | B2 | 2/2012 | Malloy et al. | |
| 8,152,551 | B2 | 4/2012 | Zraik | |
| 8,157,588 | B1 | 4/2012 | Rodrigues et al. | |
| 8,157,589 | B2 | 4/2012 | Krenceski et al. | |
| 8,167,635 | B1 | 5/2012 | Mathews | |
| 8,167,636 | B1 | 5/2012 | Montena | |
| 8,167,646 | B1 | 5/2012 | Mathews | |
| 8,172,612 | B2 | 5/2012 | Bence et al. | |
| 8,192,237 | B2 | 6/2012 | Purdy et al. | |
| 8,287,320 | B2 | 10/2012 | Purdy et al. | |
| 8,313,345 | B2 | 11/2012 | Purdy | |
| 8,313,353 | B2 | 11/2012 | Purdy et al. | |
| 8,323,060 | B2 | 12/2012 | Purdy et al. | |
| 8,366,481 | B2 * | 2/2013 | Ehret et al. | 439/578 |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2003/0224657 | A1 | 12/2003 | Malloy | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2007/0026734 | A1 | 2/2007 | Bence et al. | |
| 2007/0049113 | A1 | 3/2007 | Rodrigues et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0289470 | A1 | 11/2008 | Aston | |
| 2009/0029590 | A1 | 1/2009 | Sykes et al. | |
| 2009/0098770 | A1 | 4/2009 | Bence et al. | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 | 9/2010 | Youtsey | |
| 2010/0255720 | A1 | 10/2010 | Radzik et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy et al. | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0111623 | A1 | 5/2011 | Burris et al. | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1 | 1/2012 | Zraik | |
| 2012/0094532 | A1 | 4/2012 | Montena | |
| 2012/0122329 | A1 | 5/2012 | Montena | |
| 2012/0145454 | A1 | 6/2012 | Montena | |
| 2012/0171894 | A1 | 7/2012 | Malloy et al. | |
| 2012/0196476 | A1 | 8/2012 | Haberek et al. | |
| 2012/0222302 | A1 | 9/2012 | Purdy et al. | |
| 2013/0034983 | A1 | 2/2013 | Purdy et al. | |
| 2013/0065435 | A1 | 3/2013 | Purdy et al. | |
| 2013/0072059 | A1 | 3/2013 | Purdy et al. | |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | A1 | 6/2005 |
| EP | 1701410 | A2 | 9/2006 |
| FR | 2232846 | A1 | 1/1975 |

(56) References Cited

FOREIGN PATENT DOCUMENTS

| | | | |
|---|---|---|---|
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 4503793 | B2 | 1/2002 |
| JP | 2002075556 | A | 3/2002 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | | 8/2006 |
| WO | 2011128665 | A1 | 10/2011 |
| WO | 2011128666 | A1 | 10/2011 |
| WO | 2012061379 | A2 | 5/2012 |

* cited by examiner

CABLE CONNECTOR

BACKGROUND

The present disclosure relates generally to the field of cable connectors (e.g., coaxial cable connectors) used to connect cables to various electronic devices such as televisions, antennas, set-top boxes, and similar devices. More specifically, the present disclosure relates to a cable connector having features to facilitate maintaining a conductive path through the connector.

Conventional coaxial cable connectors generally include a connector body, a nut coupled to the connector body, and an annular post coupled to the nut and/or the body. A locking sleeve may further be used to secure a coaxial cable within the body of the coaxial cable connector. Typically, the nut and the annular post are constructed of conductive metals or conductive plastics. A conductive path is formed from an outer conductor of the cable to the electronic device via the post of the connector.

It would be advantageous to provide a connector with an improved conductive path formed between the post and nut.

SUMMARY

One embodiment relates to a cable connector. The cable connector includes a body having a forward end and a rearward end opposite the forward end, a post disposed at least partially within the body, a fastener coupled to the forward end of the body, and a compressible member disposed on an outer surface of the body. The rearward end of the body is configured to receive a cable. The post includes a flange portion extending radially from a forward end of the post. The fastener is configured to engage a mating connector. The fastener is axially movable between a forward position and a rearward position, and wherein the fastener comprises an interior surface configured to contact the flange portion of the post when the fastener is in the forward position. The compressible member is configured to force the fastener toward the forward position such that the interior surface of the fastener provides a continuous pressure against the flange of the post when the fastener is in the forward position.

Another embodiment relates to a coaxial cable connector. The coaxial cable connector includes a connector body having a forward end and a rearward end opposite the forward end, an annular post disposed at least partially within the connector body, a fastener coupled to the forward end of the body and configured to engage a mating connector, and a spring element disposed between the fastener and an outer surface of the connector body. The rearward end of the body is configured to receive a coaxial cable. The post includes a flange portion extending radially from a forward end of the annular post. The fastener is axially movable between a forward position and a rearward position. The fastener comprises an interior surface configured to contact the flange portion of the post when the fastener is in the forward position. The spring element is configured to exert a force on the fastener in a forward direction toward the forward position such that the interior surface of the fastener remains in substantially continuous contact with the flange of the post unless another force is exerted on the fastener in a rearward direction.

Yet another embodiment relates to a coaxial cable connector including a connector body having a forward end and a rearward end opposite the forward end, an annular post disposed at least partially within the connector body, a fastener coupled to the forward end of the body and configured to engage a mating connector, and an elastomeric element having a flat, elongated inner surface. The body includes a rearward end configured to receive a coaxial cable. The annular post includes a flange portion extending radially from a forward end of the annular post. The fastener is axially movable between a forward position and a rearward position. The fastener comprises an interior surface configured to contact the flange portion of the post when the fastener is in the forward position. The elastomeric element is disposed over at least a portion of an outer surface of the fastener. The elastomeric element is compressed between the connector body and the fastener in both the forward position and the rearward position and configured to exert force on the fastener to press the fastener in a forward direction toward the forward position.

DETAILED DESCRIPTION

Referring to the FIGURES generally, coaxial cable connectors typically include a connector body (e.g., an annular collar) for accommodating a coaxial cable. A fastener (e.g., an annular nut) may be rotatably connected to the body for providing mechanical attachment of the connector to an external device (e.g., a mating connector). An annular post may be coupled to the body. The nut may include a threaded portion or other attachment feature (e.g., for attachment to an F-type port, RCA port, a BNC port, another connector such as a coupling connector, etc.) that enables attachment of the connector to a mating connector or other device. The body includes a rearward portion configured to receive the coaxial cable. The connector may further include a locking sleeve or other component intended to facilitate retention of the cable within the connector. Various exemplary embodiments are provided that are configured to facilitate a solid physical and electrical connection between the fastener and the post by providing a force or pressure in the forward direction (e.g., toward an end of the connector configured to contact the port or other connector). In some embodiments, the force or pressure may be exerted on the fastener by a compressible member disposed on an outer surface of the body (e.g., between the body and the fastener). In some embodiments, connectors may continue to propagate and shield RF signals regardless of torque requirements (e.g., as recommended by the Society of Cable Telecommunications Engineers).

Figure 1:
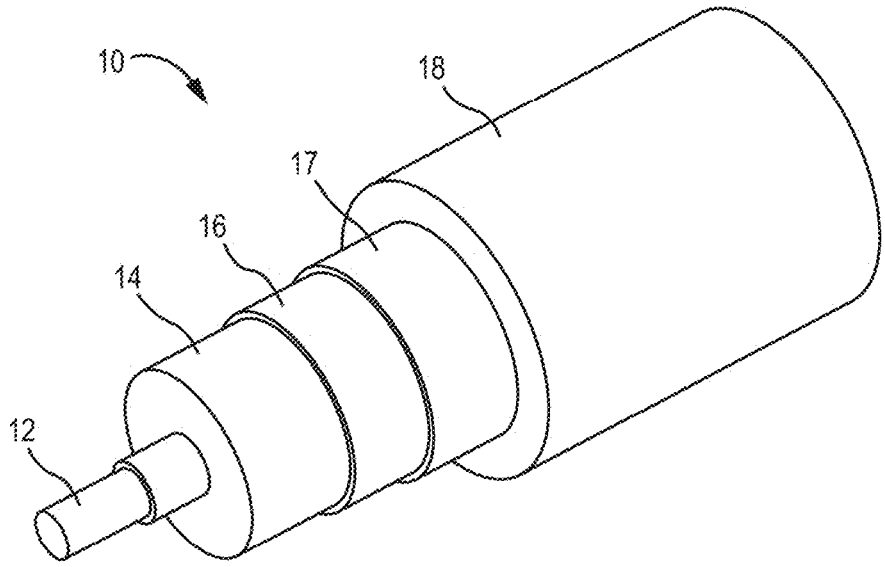
FIG. 1 is an isometric view of a coaxial cable according to an exemplary embodiment.

Referring to FIG. 1, a cable 10 includes a center core, shown as inner conductor 12; a dielectric insulator 14 surrounding inner conductor 12; a woven or braided shield surrounding insulator 14, shown as outer conductor 16; and a sheath surrounding outer conductor 16, shown as outer jacket 18. Typically, inner conductor 12 carries a signal, and outer conductor 16 is coupled to ground. A connector 20 is coupled to an end of cable 10. Various embodiments disclosed herein relate to an annular post, a fastener, or related components that are usable to electrically couple a coaxial cable to an electronic device (e.g., via a mating connector). In some embodiments, an annular post and/or fastener may be formed of a non-conductive material and plated with a conductive material such that a continuous ground path is created from the outer conductor 16 of the coaxial cable to the mating connector (e.g., a grounding path). While the cable is shown as a coaxial cable, in other embodiments, the cable may be any suitable signal transmission cable (e.g., a cable transmitting CATV, Satellite, CCTV, VoIP, data, video, digital, high speed internet, etc.) that is connected via connector 20 to a corresponding connector or terminal of a device (e.g., an electronic device, a splitter, etc.) or to another cable (e.g., to splice two cables together). In various embodiments, cables used with connectors disclosed herein may be single-conductor cables (e.g., speaker wires), single-shield cables, dual-shield cables, tri-shield cables, quad-shield cables, etc.

Figure 2:
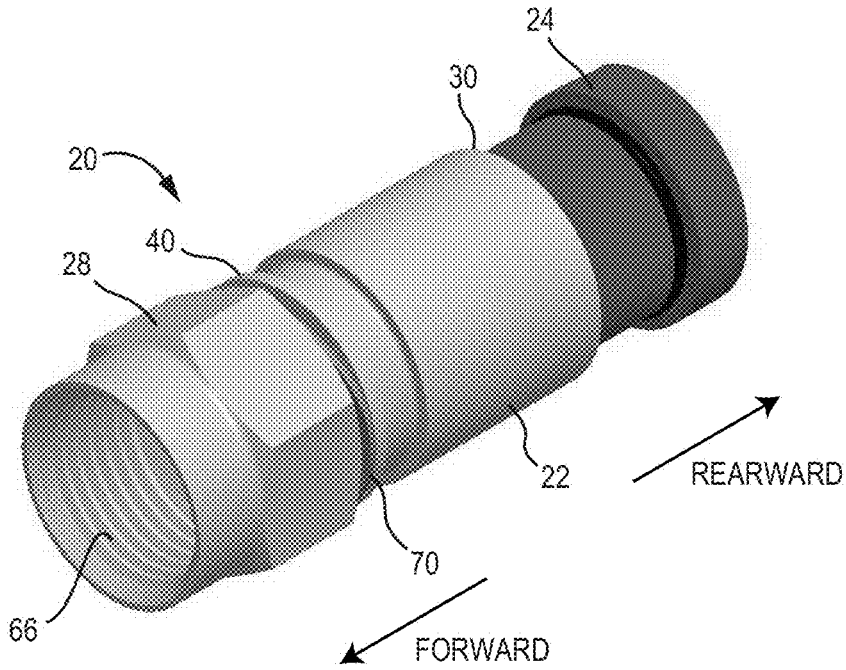
FIG. 2 is an isometric view of a coaxial connector according to an exemplary embodiment.
Figure 3:
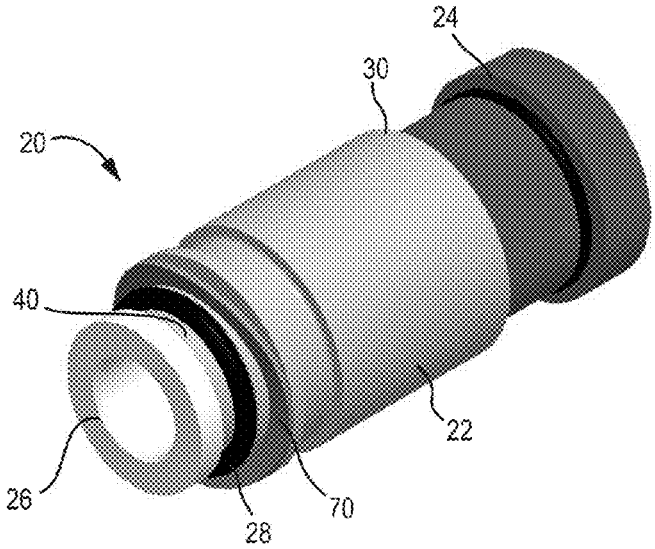
FIG. 3 is an isometric view of the coaxial connector of FIG. 2 with the fastener removed according to an exemplary embodiment.
Figure 4:
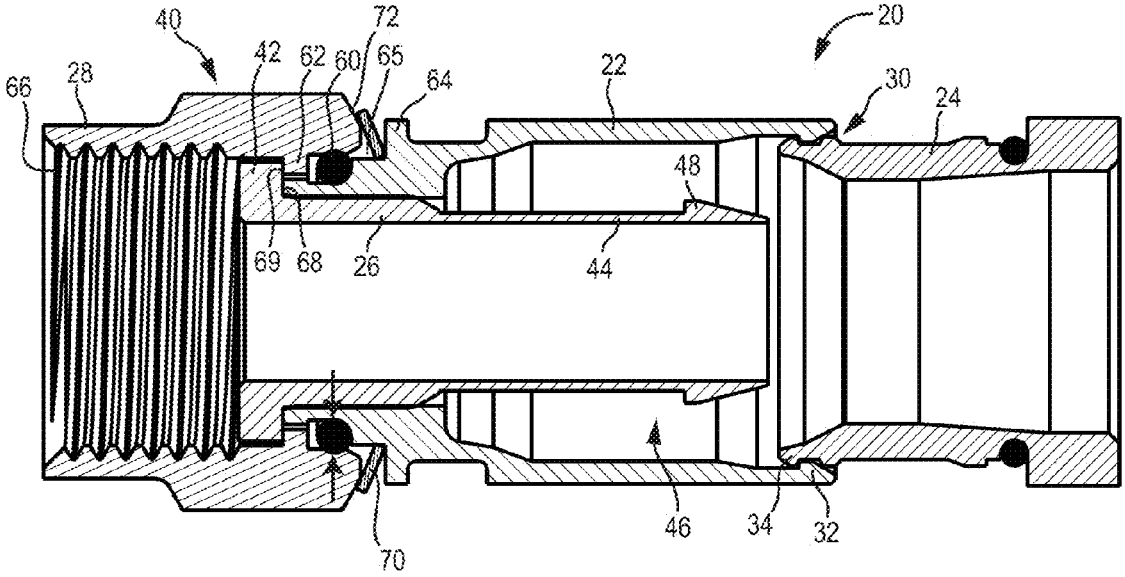
FIG. 4 is a cross-section view of the coaxial connector of FIG. 2 according to an exemplary embodiment.

Referring to FIGS. 2-4, a connector 20 is shown according to one exemplary embodiment. Connector 20 is configured to be coupled to the end of a coaxial cable 10, and includes a connector body 22 (e.g., a collar, body portion, etc.), a sleeve 24 (e.g., a locking sleeve, compression sleeve, compressible member, etc.), and a fastener 28 (e.g., a threaded nut, a hex nut, F-type interface, RCA interface, BNC interface, etc.) which may or may not be threaded. Connector 20 further includes a post 26 (see FIGS. 3-4) provided within one or more of body 22, locking sleeve 24, and fastener 28. Connector 20 may include one or more sealing members 60 (e.g., o-rings, elastomeric o-rings, conductive o-rings, etc.) and one or more compressible members. In some embodiments, one or more sealing members 60 may be compressed (e.g., between fastener 28 and body 22) in a radial and/or axial direction; in other embodiments, the one or more sealing members 60 may be uncompressed. In one embodiment, connector 20 is configured to be used in 75 ohm RF coaxial systems. In other embodiments, connector 20 may be configured to be used in RF coaxial systems with other characteristic impedences (e.g., 50 ohm, 93 ohm, etc.).

Connector body 22 can be made of a metallic material such as aluminum or copper that can be casted, extruded, or machined. In other embodiments, connector body 22 may be made of a polymer, another material, or combination of materials. Connector body 22 is a generally cylindrical body including a first end 30 (e.g., rear end, cable receiving end, etc.) with an inner diameter sized to receive the outer diameter of the outer jacket 18 with a small amount of excess space.

First end 30 of body 22 may be configured to receive sleeve 24 and may include an inwardly extending projection 32 for coupling with locking sleeve 24. In other embodiments, connector body 22 may include another feature such as a groove, recess, or detent for coupling connector body 22 to locking sleeve 24. Coupling features may be provided on the inner surface or outer surface of connector body 22. Locking sleeve 24 is a substantially tubular member that receives the end of coaxial cable 10. Locking sleeve 24 may include one or more ridges or projections 34, which cooperate with the projection 32 on the connector body 22 to couple locking sleeve 24 to connector body 22.

Connector body 22 has an opposite second end 40 (e.g., front end, forward end, etc.). Second end 40 is operatively coupled to post 26 and fastener 28. Post 26 and fastener 28 may be at least partially formed of a conductive material. According to one exemplary embodiment, post 26 and fastener 28 are formed from a metallic material such as aluminum or copper that can be casted, extruded, or machined. According to other exemplary embodiments, post 26 and fastener 28 are formed from another suitable material such as a conductive polymer.

Post 26 may include a flange 42 for securing an axial relationship between post 26 and fastener 28 and/or connector body 22. Flange 42 contacts second end 40 of connector body 22 to limit the movement of post 26 relative to connector body 22. Post 26 may also include an annular extension 44 that is received in connector body 22. An annular chamber 46 is formed between extension 44 and connector body 22 for receiving outer conductor 16 and outer jacket 18 of coaxial cable 10. According to an exemplary embodiment, the distal end of annular extension 44 includes an outwardly extending ramped flange portion or "barb" 48 to compress outer conductor 16 and outer jacket 18 of coaxial cable 10 in annular chamber 46 and facilitate the retention of coaxial cable 10 in connector body 22.

According to an exemplary embodiment, connector 20 may further include a sealing member 60 to provide a seal between fastener 28 and connector body 22. Sealing member 60 reduces the likelihood that moisture, debris or other undesirable materials will enter the interior of connector 20 (e.g., annular chamber 46). According to an exemplary embodiment, sealing member 60 is an O-ring that is compressed in a radial direction between connector body 22 and fastener 28. In other exemplary embodiments, sealing member 60 may be another resilient body such as a gasket or an elastomeric material integrally formed with connector body 22 or fastener 28 or coupled to connector body 22 or fastener 28.

Fastener 28 is rotatably coupled to second end 40 of connector body 22. Fastener 28 may include an inwardly extending shoulder or flange 62. The axial movement of fastener 28 in a forward direction relative to connector body 22 and post 26 is limited by the contact of flange 62 of fastener 28 with flange 42 of post 26.

Fastener 28 may include various features to facilitate the rotation of fastener 28 relative to connector body 22. For instance, according to various exemplary embodiments, fastener 28 may comprise a hex nut, a wing nut, a nut with a knurled surface for finger-tightening, a nut with an overmold feature (see FIG. 15-16), or another suitable fastener. Fastener 28 is configured to provide an element or assembly for coupling connector 20 to the terminal of an electronic or other device. According to an exemplary embodiment, fastener 28 includes a central bore or cavity with internal threads 66 that engage the threads of a terminal of the device (e.g., a port) and/or another connector or coupling device.

Figure 14:
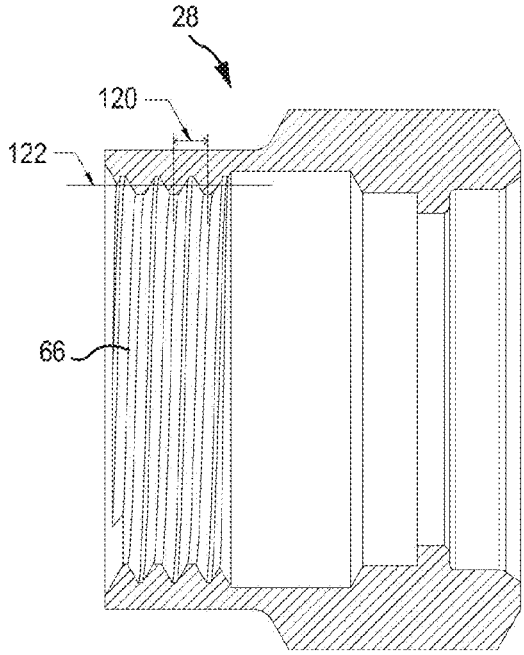
FIG. 14 is a cross section of a fastener for a coaxial connector according to another exemplary embodiment.

As shown in FIG. 14. according to one exemplary embodiment, internal threads 66 may have a reduced pitch diameter 120 (e.g., less than 0.3556 inches) to gain a tighter fitting thread with the mating thread of the port or terminal on the device, connector or coupling device engaging internal threads 66. According to an exemplary embodiment, threads 66 have a pitch diameter of less than 0.3556 inches. In one particular embodiment, internal threads 66 have a pitch diameter of approximately 0.3547 inches. The tighter fitting threaded connection may improve the shielding effectiveness of the threaded connection of fastener 28.

According to another embodiment, the number of threads per inch (TPI) 122 of inner threads 66 is reduced (e.g., less than 32 TPI) to increase the likelihood that internal threads 66 are always in contact with the thread of the port or terminal on the device, connector or coupling device engaging internal threads 66. The number of threads 66 may be similarly reduced to avoid damaging the mating threads. According to an exemplary embodiment, threads 66 have a pitch between 32 and 30 TPI. According to one particular embodiment, fastener 28 may include a minimum of 3 full threads 66 but no more than 4 full threads 66 at a pitch of between 31 and 32 TPI. In one embodiment, fastener 28 may have threads 66 with both a reduced pitch diameter and a reduced TPI. In some embodiments, connectors including a fastener with a reduced pitch diameter and/or a reduced TPI may also include a compressible member configured to apply a force against the fastener to press the fastener into contact with a post of the connector.

Figure 17:
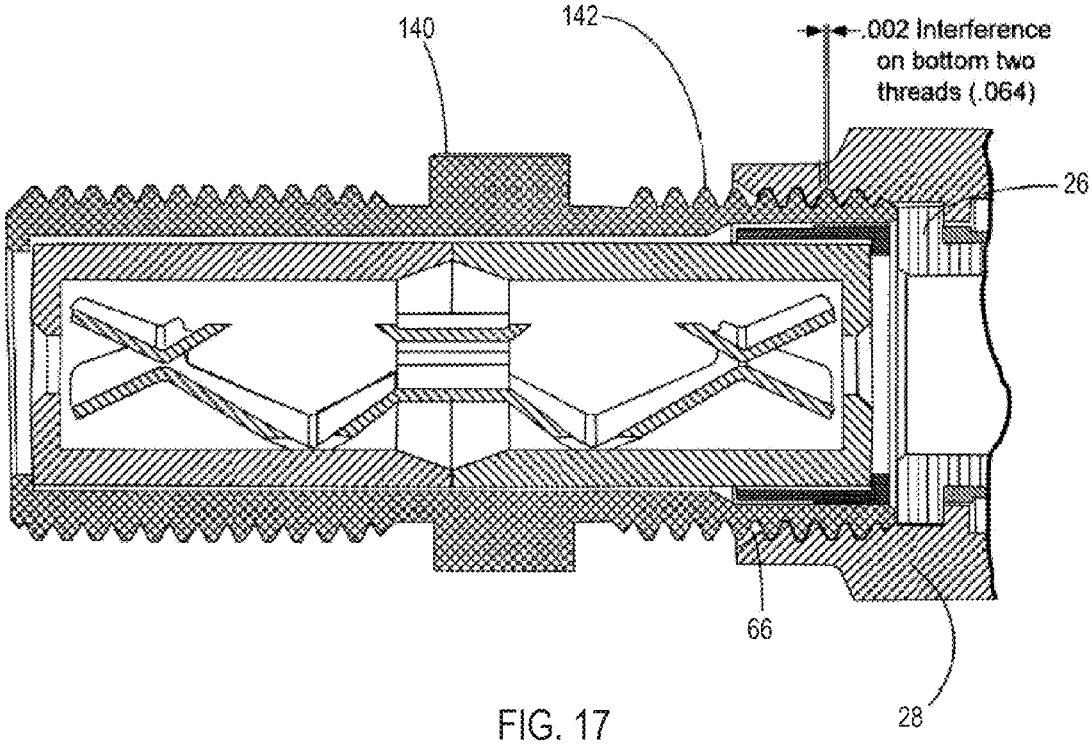
FIG. 17 is a cross section of a coaxial connector according to another exemplary embodiment.

As shown in FIG. 17, according to another embodiment, mismatching of the threads can be achieved by providing fewer threads per unit length (e.g., per inch) on threads 66 (e.g., internal threads) of fastener 28 than the standard threads per unit length (e.g., per inch) formed on the threads of port connector 140. Specifically, typical port connectors 140 may be formed with a standard ⅜-32 external thread 142. This means that external thread 142 has 32 threads per inch. Thus, by forming internal threads 66 of fastener 28 with, for example, 30 threads per inch, an interference fit between threads 66 and 142 can be created. Using these values, it can be seen that an interference fit of 0.002 inches in the area of the rearward most threads is created. The interference results in fastener 28 resisting "backing-off" or loosening and provides a seal against water migration.

In a first position, flange 62 of fastener 28 contacts flange 42 of post 26 to form a conductive path via annular contact surface 68 on flange 42 and annular contact surface 69 (e.g., interior surface) on flange 62. In a second position, flange 62 of fastener 28 is moved in a rearward direction relative to post 26, breaking the conductive path between fastener 28 and post 36. A compressible member (e.g., spring element, flexible element, compressible material, etc.) is provided to apply a force (e.g., a continuous pressure) in the forward direction to fastener 28 (e.g., away from first end 30 of connector body 22) and maintain the contact between surface 68 and 69. The compressible member may be compressed in a linear direction, axial direction, radial direction, etc. While being forced in a forward direction by the compressible member, in the first position, fastener 28 is able to be rotated to couple connector 20 to the terminal of an electronic device. According to an exemplary embodiment, a force of at least approximately ½ lb. is applied to maintain the contact between surface 68 and 69.

According to an exemplary embodiment, the force exerted by the compressible member on fastener 28 is sufficient to maintain contact between contact surfaces 68 and 69 not only if fastener 28 is fully tightened (i.e., tightened to a torque of 25-30 in/lb as recommended by the Society of Cable Telecommunication Engineers), but also through approximately 3 or 4 rotations of fastener 28 (e.g., sealing against egress). While the compressible member is under compression (e.g., exerting an opposite and equal force against flange 62 of fastener 28 and flange 64 of body 22), signals continue to pass through a front surface plane of fastener 28. Electrical and RF signals may pass through fastener 28 during rotation of fastener 28. In some embodiments, there may be a slight (angular) center line misalignment of the male and female connectors (e.g., perpendicular to both reference planes) to prevent signal loss (e.g., ingress and egress). In some embodiments, the compressible member may apply a force that causes flange 62 of fastener 28 to contact flange 42 of post 26 with a gap or clearance between the flanges of less than 0.012 nominal inches. In some embodiments, The compressible member may apply a force to fastener 28 in both the first position and the second position. In some embodiments, at least a portion of the compressible member may be external to fastener 28 in one or both of an axial and a radial direction. The compressible member may be used with one or more modifications to threads 66, as described above, to further improve the conductive coupling of post 26 and fastener 28.

As shown in FIGS. 2-4, according to one exemplary embodiment, the compressible member comprises a flexible washer or wave spring 70 provided between fastener 28 and connector body 22. A recess is formed between an outward-facing surface 65 of connector body 22 (e.g., facing at least partially away from a center point of the connector, facing at least partially away from a longitudinal axis of the body and/or post, facing at least partially away from the body and/or post in an axial and/or radial direction, etc.), the rearward end 72 of fastener 28 and a flange or forward-facing surface 64 of connector body 22. Wave spring 70 is compressed between the rearward end 72 of fastener 28 and flange 64 of connector body 22, applying a force in the forward direction to fastener 28 away from connector body 22 and against post 26. In some embodiments, wave spring 70 may be configured to apply a substantially continuous pressure to fastener 28, urging fastener 28 into substantially continuous physical and electrical contact with post 26. In other embodiments, wave spring 70 may instead be another suitable spring device such as a helical coil spring, a conical spring, etc.

Figure 5:
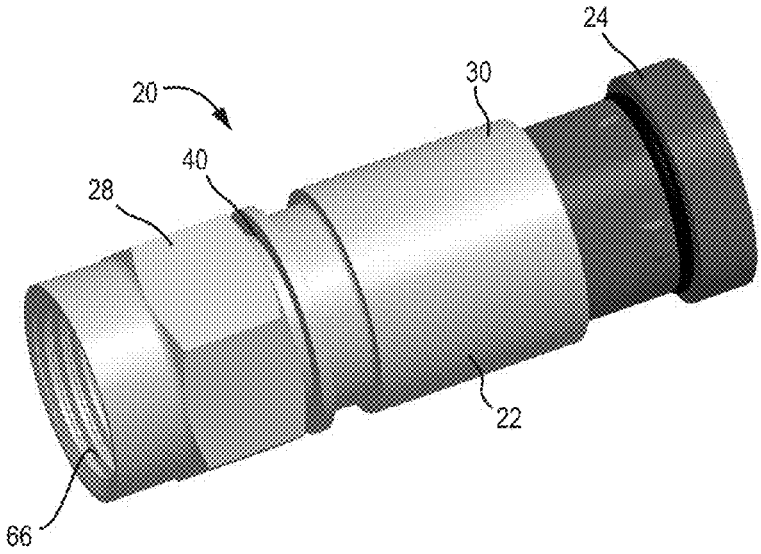
FIG. 5 is an isometric view of a coaxial connector according to an exemplary embodiment.
Figure 6:
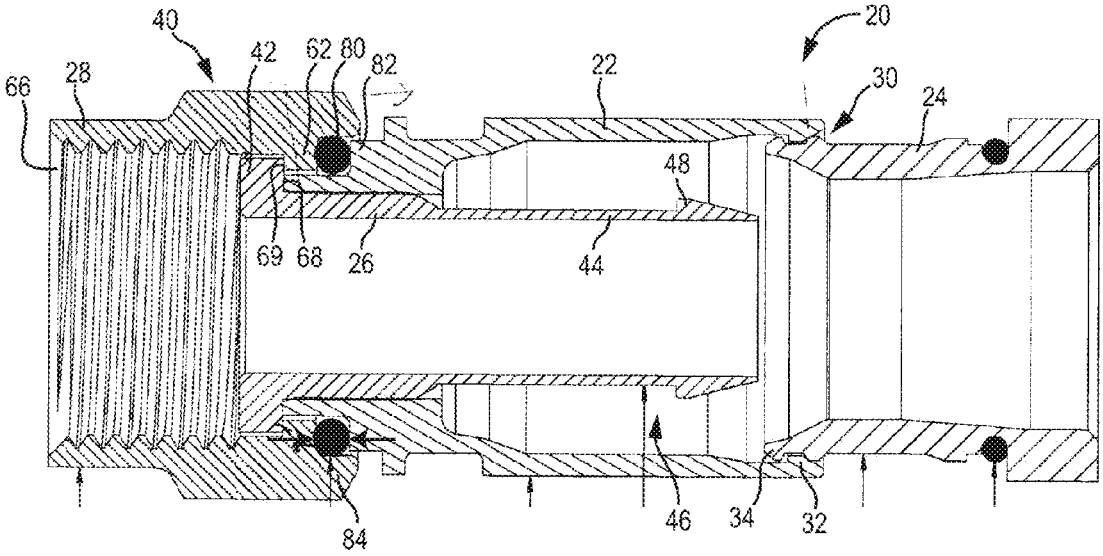
FIG. 6 is a cross-section view of the coaxial connector of FIG. 5 according to an exemplary embodiment.
Figure 13:
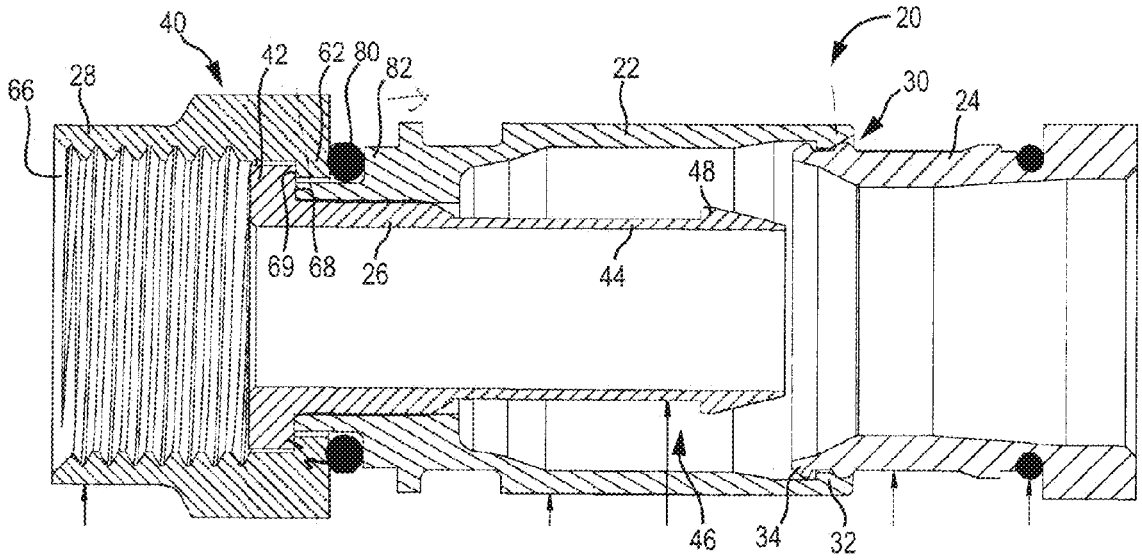
FIG. 13 is a cross-section view of a coaxial connector according to another exemplary embodiment.

Referring now to FIGS. 5-6, according to another exemplary embodiment, the compressible member comprises an O-ring 80. In some embodiments, O-ring 80 may not be compressed radially between connector body 22 and fastener 28. O-ring 80 is received in a gap between flange 62 and an annular ledge (or forward-facing surface) 82 of connector body 22. The uncompressed diameter of O-ring 80 is greater than the width of the gap between flange 62 and annular ledge 82, compressing O-ring 80 in an axial direction (e.g., front to rear, parallel to the longitudinal axis, etc.) and forcing fastener 28 in a forward direction away from connector body 22 and against post 26. While shown as an O-ring with a circular cross-section, in other exemplary embodiments, the compressible member may be otherwise formed. For example, in other exemplary embodiments, the compressible member may be an O-ring with another cross-section (e.g., square, X-shaped, rectangular, ovoid, etc.). In other exemplary embodiments, the compressible member may be integrally formed with the connector body 22 or the fastener 28 (e.g., co-molded, overmolded, sprayed, etc.). According to one exemplary embodiment, fastener 28 includes an annular projection 84 extending rearward from flange 62 that substantially covers O-ring 80. Referring to FIG. 13, according to another exemplary embodiment, fastener 28 may be configured such that fastener 28 does not cover or surround O-ring 80 in at least one of an axial and/or radial direction. In some embodiments, a portion of body 22 may be configured to overlap, cover and/or surround at least a portion of O-ring 80.

Figure 7:
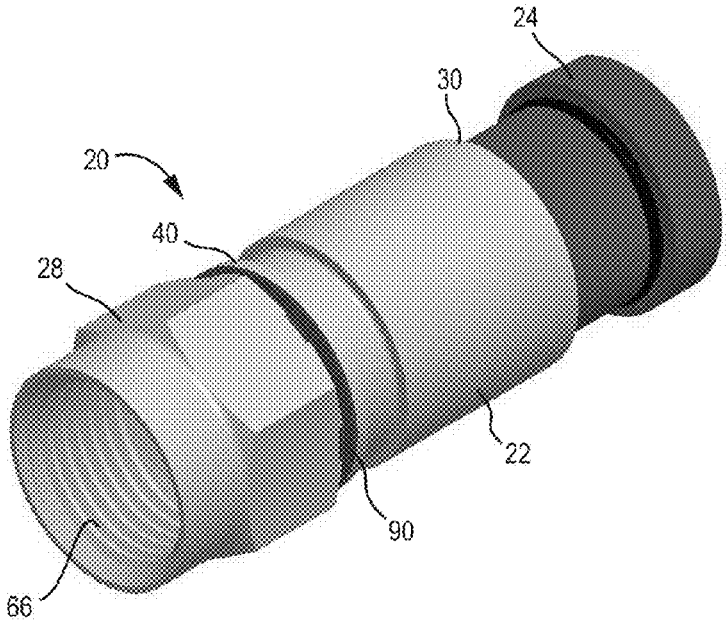
FIG. 7 is an isometric view of a coaxial connector according to an exemplary embodiment.
Figure 8:
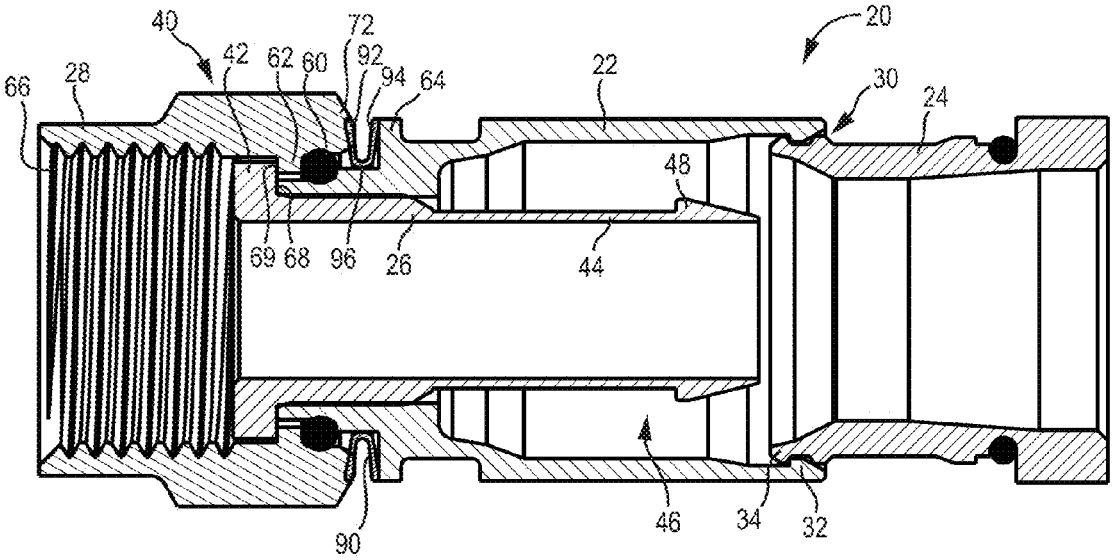
FIG. 8 is a cross-section view of the coaxial connector of FIG. 7 according to an exemplary embodiment.

Referring now to FIGS. 7-8, according to another exemplary embodiment, the compressible member comprises a ring-shaped spring element 90. Spring element 90 has a substantially V-shaped or wedge-shaped cross-section with a first arm 92 and a second arm 94 joined by a hinge portion 96. In some embodiments, second arm 94 may be a portion of a substantially continuous ring-shaped base portion configured to contact body 22. Spring element 90 is formed from a metallic material, a polymer material, or any other material with a suitable modulus of elasticity. First arm 92 contacts rearward end 72 of fastener 28 and second arm 94 contacts flange or annular ledge or forward-facing surface 64 of connector body 22. First arm 92 and second arm 94 are forced away from each other by hinge portion 96, applying a force in the forward direction to fastener 28 away from connector body 22 and against post 26. In various embodiments, first arm 92 may be a continuous body (e.g., such that ring-shaped spring element 90 may include two continuous ring-shaped portions connected by a hinge portion and/or have a collar-like shape) or may comprise several discrete portions. According to one exemplary embodiment, first arm 92 comprises six flexible wedge-shaped portions. Portions of first arm 92 may be received in one or more recesses in rearward end 72 of fastener 28.

Figure 9:
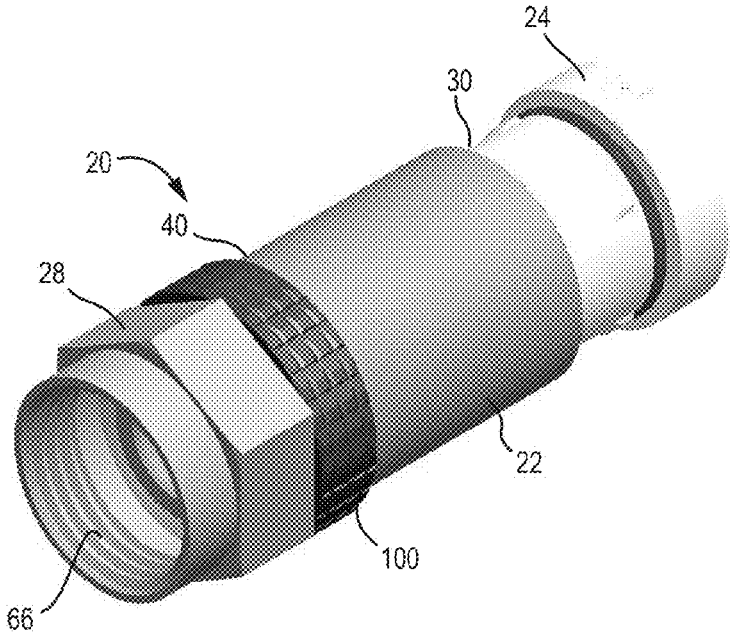
FIG. 9 is an isometric view of a coaxial connector according to an exemplary embodiment.
Figure 10:
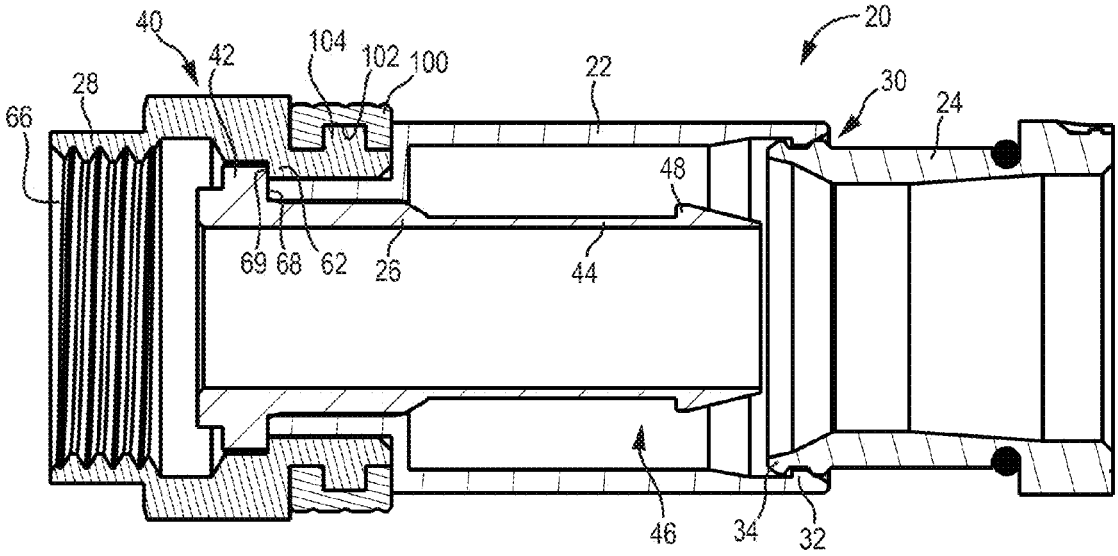
FIG. 10 is a cross-section view of the coaxial connector of FIG. 9 according to an exemplary embodiment.

Referring now to FIGS. 9-10, according to another exemplary embodiment, the compressible member comprises a ring-shaped elastomeric sleeve 100. Sleeve 100 is a resilient material such as a thermoplastic vulcanizate, marketed as Santoprene by Advanced Elastomer Systems, L.P. Sleeve 100 may be formed by an overmolding process. Sleeve 100 has a C-shaped cross section with a groove 102 that receives a corresponding radially-extending ridge 104 (e.g., projection, shoulder, etc.). A portion of sleeve 100 is compressed between ridge 104 of fastener 28 and ledge 82 of connector body 22, applying a force in the forward direction to fastener 28 away from connector body 22 and against post 26. Sleeve 100 includes at least one elongated, flat surface formed over at least a portion of fastener 28. In some embodiments, an outer surface of sleeve 100 may include features (e.g., knurling, ridges, bumps, etc.) configured to enable easier gripping of the connector. In some embodiments, sleeve 100 may be configured to have an outer diameter that is equal to or smaller than an outer diameter of fastener 28 (e.g., to allow tools to be slid past sleeve 100 and into contact with fastener 28 under a security shield).

Figure 11:
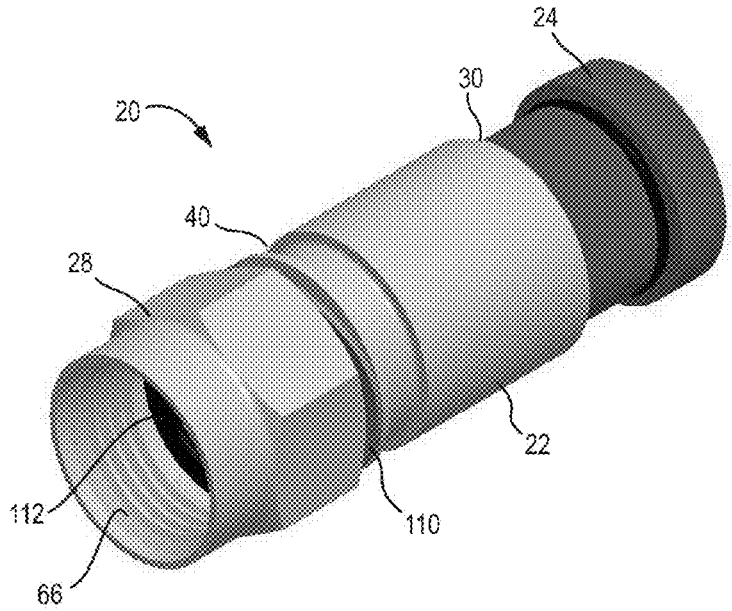
FIG. 11 is an isometric view of a coaxial connector according to an exemplary embodiment.
Figure 12:
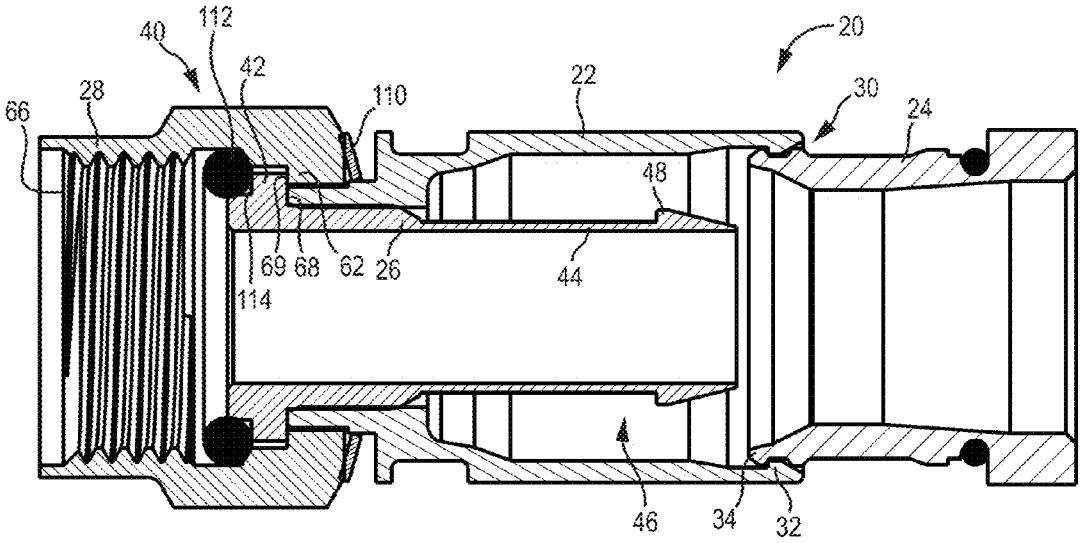
FIG. 12 is a cross-section view of the coaxial connector of FIG. 11 according to an exemplary embodiment.

Referring now to FIGS. 11-12, according to another exemplary embodiment, the compressible member comprises a wave spring 110 similar to the wave spring 70 in FIGS. 2-4. Wave spring 110 is provided between fastener 28 and connector body 22. Wave spring 110 is compressed between the rearward end 72 of fastener 28 and flange 64 of connector body 22, applying a force in the forward direction to fastener 28 away from connector body 22 and against post 26. As shown in FIGS. 11-12, sealing member 112 is an O-ring that is received in a recess 114 on the forward end of flange 42 of post 26. When connector 20 is coupled to the terminal, sealing member 112 is compressed in an axial direction between the terminal and fastener 28. In some embodiments, sealing member 112 may be a non-conductive material intended to restrict or reduce migration of moisture between at least a portion (e.g., a rearward portion) of fastener 28 and post 26 and/or body 22 without conducting electricity. In some embodiments, sealing member 112 may be configured to block, restrict or reduce migration of moisture between at least a portion (e.g., a rearward portion) of fastener 28 and post 26 and/or body 22 but not substantially restrict migration of moisture between a threaded portion of fastener 28 and a corresponding threaded portion of a mating connector.

Figure 15:
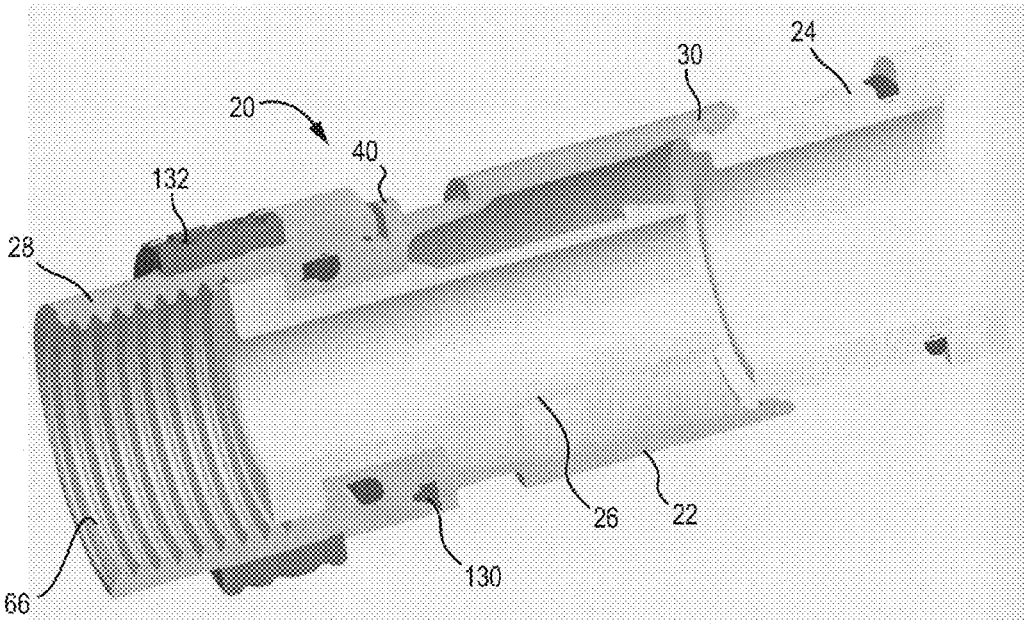
FIG. 15 is a cross section of a coaxial connector according to another exemplary embodiment.
Figure 16:
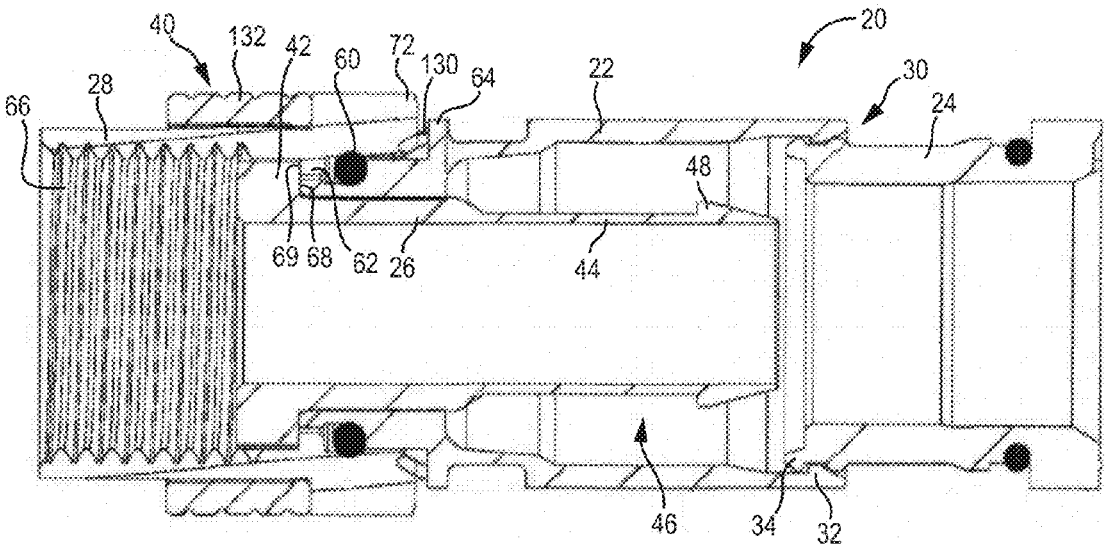
FIG. 16 is a cross section of a coaxial connector according to another exemplary embodiment.

Referring now to FIGS. 15-16, according to another exemplary embodiment, the compressible member comprises a conical spring 130 provided between fastener 28 and connector body 22. Conical spring 130 is compressed between the rearward end 72 of fastener 28 and flange 64 of connector body 22, applying a force in the forward direction to fastener 28 away from connector body 22 and against post 26.

By providing a compressible element to apply an axial force in the forward direction to fastener 28, a more consistent surface-to-surface contact is maintained between fastener 28 and post 26 via contact surfaces 68 and 69. In this way, a more consistent conductive path (e.g., a grounding path) is maintained between outer conductor 16 and a device to which cable 10 is coupled via connector 20. Improved contact between surfaces 68 and 69 may also provide power bonding and grounding (e.g., helps promote a safer bond connection per NEC® (National Electrical Code) Article 250). The improved conductive contact between fastener 28 and post 26 further improves RF shielding (e.g., signal ingress and egress).

References herein to the positions of elements (e.g., "front", "rear", "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It should be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The construction and arrangement of the elements of the connector as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures (e.g., fastener 28). This should not be construed as an implication that these components are identical in all embodiments; various modifications may be made in various different embodiments. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the spirit of the appended claims.

What is claimed is:

1. A cable connector, comprising:

a body having a forward end and a rearward end opposite the forward end, the rearward end configured to receive a cable;

a post disposed at least partially within the body and comprising a flange portion extending radially from a forward end of the post; and a fastener coupled to the forward end of the body and configured to engage a mating connector, wherein the fastener is axially movable between a forward position and a rearward position, and wherein the fastener comprises an interior surface configured to contact the flange portion of the post when the fastener is in the forward position; and a compressible member disposed on an outer surface of the body, the compressible member having a ring-shaped base element and at least one wedge-shaped flexible portion, wherein the compressible member is configured to force the fastener toward the forward position such that the interior surface of the fastener provides a continuous pressure against the flange of the post when the fastener is in the forward position.

2. A coaxial cable connector, comprising:

a connector body having a forward end and a rearward end opposite the forward end, the rearward end configured to receive a coaxial cable;

an annular post disposed at least partially within the connector body and comprising a flange portion extending radially from a forward end of the annular post; and a fastener coupled to the forward end of the body and configured to engage a mating connector, wherein the fastener is axially movable between a forward position and a rearward position, and wherein the fastener comprises an interior surface configured to contact the flange portion of the post when the fastener is in the forward position; and a spring element disposed between the fastener and an outer surface of the connector body, wherein the spring element comprises a plurality of wedge-shaped flexible elements and is configured to exert a force on the fastener in a forward direction toward the forward position such that the interior surface of the fastener remains in substantially continuous contact with the flange of the post unless another force is exerted on the fastener in a rearward direction.

3. The cable connector of claim 1, wherein the ring-shaped base element is configured to contact an outward-facing shoulder of the body, and wherein the at least one wedge-shaped flexible portion extends from the ring-shaped base element and contacts the fastener, and wherein the at least one wedge-shaped flexible portion is configured to exert a force on the fastener in a forward direction toward the forward position.

4. A coaxial cable connector, comprising:

a connector body having a forward end and a rearward end opposite the forward end, the rearward end configured to receive a coaxial cable;

an annular post disposed at least partially within the connector body and comprising a flange portion extending radially from a forward end of the annular post; and a fastener coupled to the forward end of the body and configured to engage a mating connector, wherein the fastener is axially movable between a forward position and a rearward position, and wherein the fastener comprises an interior surface configured to contact the flange portion of the post when the fastener is in the forward position;

an elastomeric element having a flat, elongated inner surface, wherein the elastomeric element is disposed over at least a portion of an outer surface of the fastener, wherein the elastomeric element is compressed between the body and the fastener in both the forward position and the rearward position and configured to exert force on the fastener to press the fastener in a forward direction toward the forward position; and a non-conductive sealing element within a rearward portion of a threaded cavity of the fastener.

5. The coaxial cable connector of claim 4, wherein the connector body comprises a first radially extending shoulder and the fastener comprises a second shoulder that is opposite the first shoulder, wherein an overmold element is compressed between the first shoulder and the second shoulder.

6. The coaxial cable connector of claim 4, wherein the elastomeric element comprises a non-conductive material.

7. The cable connector of claim 1, further comprising a non-conductive sealing element within a rearward portion of a threaded cavity of the fastener.

8. The cable connector of claim 1, wherein the compressible member is disposed external to the fastening element in at least one of an axial direction and a radial direction.

9. The cable connector of claim 1, wherein the compressible member comprises a non-conductive material.

10. The coaxial cable connector of claim 1, wherein the continuous pressure comprises a pressure of at least 0.5 pounds.

11. The coaxial cable connector of claim 2, further comprising a non-conductive sealing element within a rearward portion of a threaded cavity of the fastener.

12. The coaxial cable connector of claim 2, wherein the spring element is disposed external to the fastening element in at least one of an axial direction and a radial direction.

13. The coaxial cable connector of claim 2, wherein the spring element is disposed between the fastener and an outer surface of the connector body, wherein each of the wedge-shaped flexible elements comprises a vertex about which the wedge-shaped flexible element is bent, a first side on one side of the vertex configured to contact the fastener, and a second side on the other side of the vertex configured to contact the connector body, wherein the wedge-shaped flexible elements are configured to exert compressive force on the fastener in a forward direction toward the forward position.

14. The coaxial cable connector of claim 13, wherein the fastener comprises a hexagonal nut portion, wherein the spring element comprises six wedge-shaped flexible elements, each of which is configured to contact the fastener at a position adjacent to a different edge of the hexagonal nut portion.

15. The coaxial cable connector of claim 2, wherein the connector body comprises a first radially extending shoulder and the fastener comprises a second shoulder that is opposite the first shoulder, wherein the spring element is compressed between the first shoulder and the second shoulder.

* * * * *

UNITED STATES PATENT AND TRADEMARK OFFICE

CERTIFICATE OF CORRECTION

PATENT NO. : 8,591,244 B2
APPLICATION NO. : 13/179158
DATED : November 26, 2013
INVENTOR(S) : Charles Thomas et al.

It is certified that error appears in the above-identified patent and that said Letters Patent is hereby corrected as shown below:

In the Claims

Claim 5, Column 10, line 31, change "first shoulder" to --first radially extending shoulder--;
line 32, change "first shoulder" to --first radially extending shoulder--.

Claim 8, Column 10, line 39, change "fastening element" to --fastener--.

Claim 10, Column 10, line 43, delete "coaxial".

Claim 12, Column 10, line 50, change "fastening element" to --fastener--.

Claim 15, Column 11, line 4, change "first shoulder" to --first radially extending shoulder--; and
line 5, change "first shoulder" to --first radially extending shoulder--.

Signed and Sealed this
Twenty-seventh Day of January, 2015

Michelle K. Lee

Michelle K. Lee
*Deputy Director of the United States Patent and Trademark Office*